United States Patent [19]

Weschenfelder et al.

[11] 4,123,048

[45] Oct. 31, 1978

[54] GEAR FOLDER

[75] Inventors: Otto T. Weschenfelder, Wurzburg; Horst B. Michalik, Hochberg, both of Germany

[73] Assignee: Koenig & Bauer Aktiengesellschaft, Wurzburg, Germany

[21] Appl. No.: 814,071

[22] Filed: Jul. 8, 1977

[30] Foreign Application Priority Data

Jul. 29, 1976 [DE] Fed. Rep. of Germany ..... 2634108

[51] Int. Cl.[2] ..... B65H 45/16

[52] U.S. Cl. ..... 270/77

[58] Field of Search ..... 270/70–77

[56] References Cited

U.S. PATENT DOCUMENTS

| | | | |
|---|---|---|---|
| 900,259 | 10/1908 | Boyce | 270/76 |
| 1,536,581 | 5/1925 | Halliwell | 270/76 |
| 2,112,078 | 3/1938 | Durham | 270/76 |

*Primary Examiner*—Edgar S. Burr
*Assistant Examiner*—A. Heinz
*Attorney, Agent, or Firm*—Jones, Tullar & Cooper

[57] ABSTRACT

A gear folder comprising a gear folding cylinder, at least a pair of folding rollers, and spaced pressure mechanisms for maintaining a precut ribbon segment in position on the folding cylinder for accurate folding of the segment. A first pressure mechanism is positioned before the folding rollers and a second similar mechanism is located after the folding rollers. These pressure mechanisms have rotating, yieldable surfaces which contact the ribbon section which is to be folded. The rotational speeds of the pressure mechanisms are different from each other and from that of the gear folding cylinder to tension the ribbon section on the folding cylinder.

6 Claims, 3 Drawing Figures

GEAR FOLDER

FIELD OF THE INVENTION

The present invention is directed generally to a gear folder for a rotary web-fed printing press. More particularly, the present invention is directed to a gear folder having pressure mechanisms to tension the precut ribbon sections on the gear folding cylinder. Most specifically, the present invention is directed to such a gear folder in which rotating pressure mechanisms, having rotational speeds differing from each other and from the gear folding cylinder, contact the precut ribbon and tension it against the cylinder during folding. The pressure mechanisms are placed around the periphery of the folding cylinder on either side of a pair of folding rollers. Each pressure mechanism includes one or more rotating members provided with resilient means such as bristles or the like to contact a precut ribbon section which is carried by the folding cylinder. The rotating members, due to their differing speeds of rotation, apply tension to the ribbon segment to hold it in place on the cylinder during the folding operation to insure that the fold is accurate.

DESCRIPTION OF THE PRIOR ART

Gear folders are generally well known in the art as may be seen, for example, by U.S. Pat. No. 3,038,719, and it is not necessary to enter into particulars as to the mode of function and the drive of the gear folding cylinders. In these gear folders, the leading end of a precut collected ribbon section which is to be folded, is "pinned up" to the gear folding cylinder by means of pins, or is held by means of grippers. The operations of withdrawing the pins or opening the grippers, of cutting and the protruding of the folding blade occur generally simultaneously so that the precut collected ribbon section to be folded becomes free of a short duration. This short term freedom of the precut collected ribbon section allows the position of the folding line to vary so that unequally folded products may be delivered.

SUMMARY OF THE INVENTION

It is an object of the present invention to provide a gear folder for web-fed rotary printing presses, in which folding of the precut collected ribbon section is effected as close as possible to the predetermined folding line over a wide range of operating speeds.

A further object of the present invention is to provide a gear folder having spaced pressure mechanisms to tension the ribbon sections on the folding cylinder.

Yet another object of the present invention is to provide a gear folder having pressure mechanisms which are adjustable to vary the tension applied to the ribbon sections.

As will be discussed in greater detail hereinafter, these objects are accomplished by providing a gear folder with spaced pressure mechanisms which may be shafts, rollers or endless belts adjustably positioned about the folding cylinder on either side of the folding rollers to contact the collected ribbon carried on the folding cylinder. The pressure mechanisms rotate at speeds differing from each other and from the speed of the folding cylinder so that the precut collected ribbon will be tensioned and maintained on the folding cylinder in a desired position for contact by the folding jaw to insure that the fold is made at the desired location.

BRIEF DESCRIPTION OF THE DRAWINGS

While the novel features of the present invention are set forth with particularity in the appended claims, a full and complete understanding of the present invention may be had by referring to the description of preferred embodiments and as may be seen in the accompanying drawings in which:

DESCRIPTION OF PREFERED EMBODIMENTS

Figure 1:
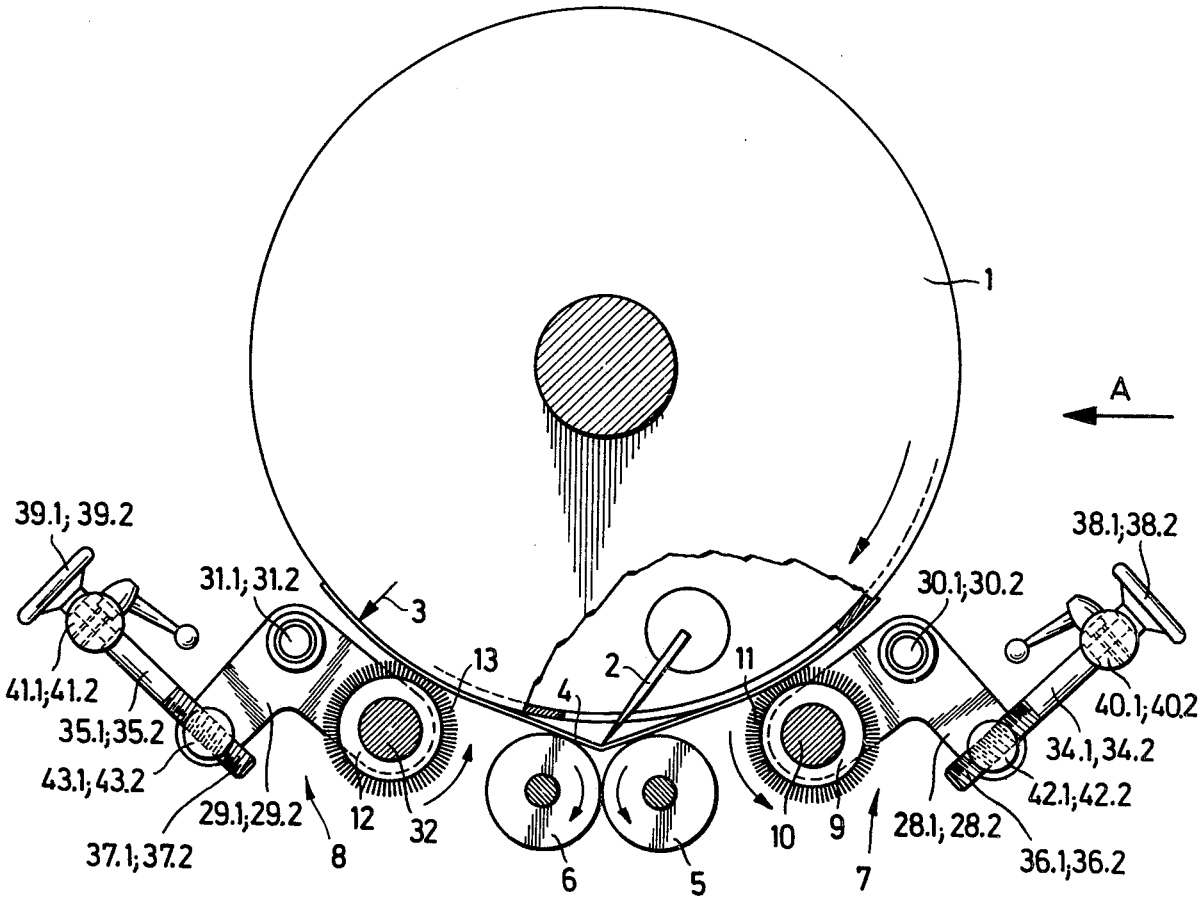
FIG. 1 is a schematic side elevation view of a first embodiment of a gear folder in accordance with the present invention, the side frames being removed for clarity.

Turning now to FIG. 1, there may be seen a first preferred embodiment of a gear folder in accordance with the present invention. The gear folder is comprised generally of a gear folding cylinder 1 which rotates in the direction of the arrow and which is equipped in a known manner with a controllable folding blade 2 and controllable pins or grippers, generally indicated at 3. A precut collected ribbon section 4 is pinned by means of the pins 3 onto the gear folding cylinder 1. The folding blade 2 presses the precut collected ribbon section 4 between a pair of rotating folding rollers 5 and 6, folding it in this way. Seen in the direction of rotation of the gear folding cylinder 1, a pressure mechanism 7 is disposed in front of the rotating folding rollers 5 and 6, with the surface of pressure mechanism 7 being in contact with the precut collected ribbon section 4. A second pressure mechanism 8 is disposed behind the folding rollers 5, 6; the surface of this second pressure mechanism 8 also being in contact with the precut collected ribbon section 4. Pressure mechanism 7 may comprise either a driven roller, or a plurality of circular disks 9, as may be seen in FIG. 2, with the disks 9 disposed side by side and fixed on a shaft 10 for rotation together with this shaft 10. The roller or disks 9 carry, over at least a portion of their periphery, bristles 11 or a similar, easily compressible material. The direction of rotation of the disks 9 is opposite to the direction of rotation of the gear folding cylinder 1, and their peripheral speed is up to 30 percent less than the peripheral speed of the gear folding cylinder 1. The pressure mechanism 8 comprises a driven shaft 32 similar to shaft 10, and a driven roller or disks 12 which are fixed on shaft 32. The periphery of the roller or disks 12 carries, over at least a portion of its periphery, bristles 13 or another pliable material. The direction of rotation of the roller or disks 12 of pressure mechanism 8 is opposite to the direction of rotation of the gear folding cylinder 1, and the peripheral speed of disks 12 is up to 30 percent more than the peripheral speed of the gear folding cylinder 1.

Figure 2:
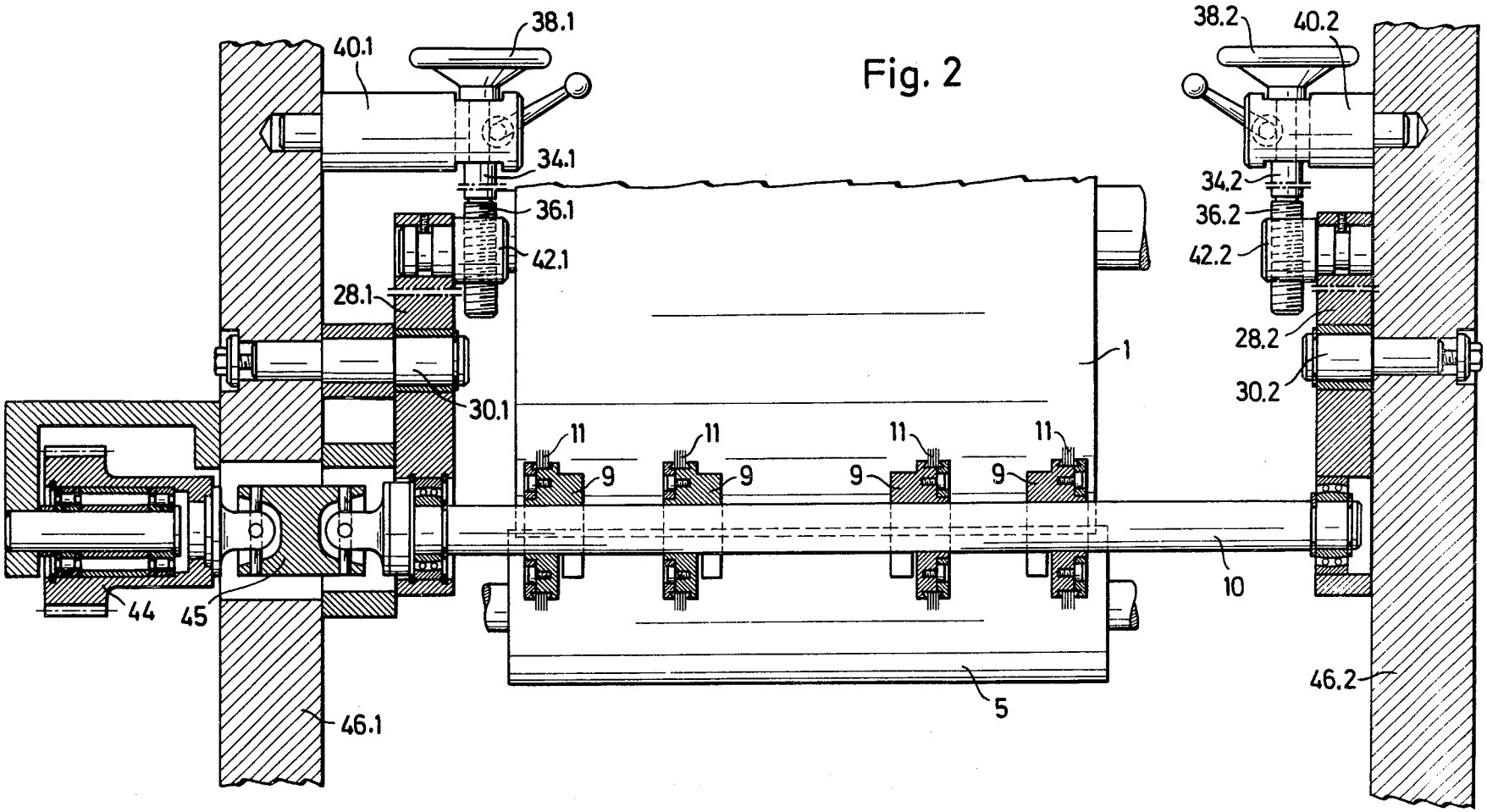
FIG. 2 is a schematic front view of the present invention as seen in the direction of arrow A in FIG. 1.

The drive of the shaft 10 which carries the disks 9 is effected from the main drive of the gear folder through a pinion 44, which is form-locked with the shaft 10 by means of a Cardan joint 45, as may be seen in FIG. 2. The drive of shaft 32 is effected in an analogous manner.

The pressure mechanisms 7 and 8 are generally identical. Therefore, the representation in FIG. 2 of the drawings is limited to the pressure mechanism 7, it being understood that pressure mechanism 8 is the same. The pressure mechanisms 7 and 8 comprise, as may be seen in FIGS. 1 and 2, angle levers 28.1, 28.2, 29.1, 29.2, which are rotatably supported on journals 30.1, 30.2, 31.1, 31.2 which are in turn fixed in side frames 46.1 and 46.2, respectively. The shafts 10 and 32 are supported in the angle levers 28.1, 28.2, 29.1, 29.2 and these levers are adjustable by threaded rods 34.1, 34.2, 35.1, 35.2 which are formed with shouldered screw threads 36.1, 36.2, 37.1, 37.2 and have attached hand wheels 38.1, 38.2, 39.1, 39.2. Rods 34.1, 34.2, 35.1, 352. are rotatably supported in supports 40.1, 40.2, 41.1, 41.2 which are fixed to the side frames 46.1, 46.2, and these rods are not capable of being axially displaced in their longitudinal direction. The screw threads 36.1, 36.2, 37.1, 37.2 of the rods 34.1, 34.2, 35.1, 35.2 each mesh with corresponding inside screw threads of joint ends 42.1, 42.2, 43.1, 43.2 which are supported in the angle levers 28.1, 28.2, 29.1, 29.2.

Figure 3:
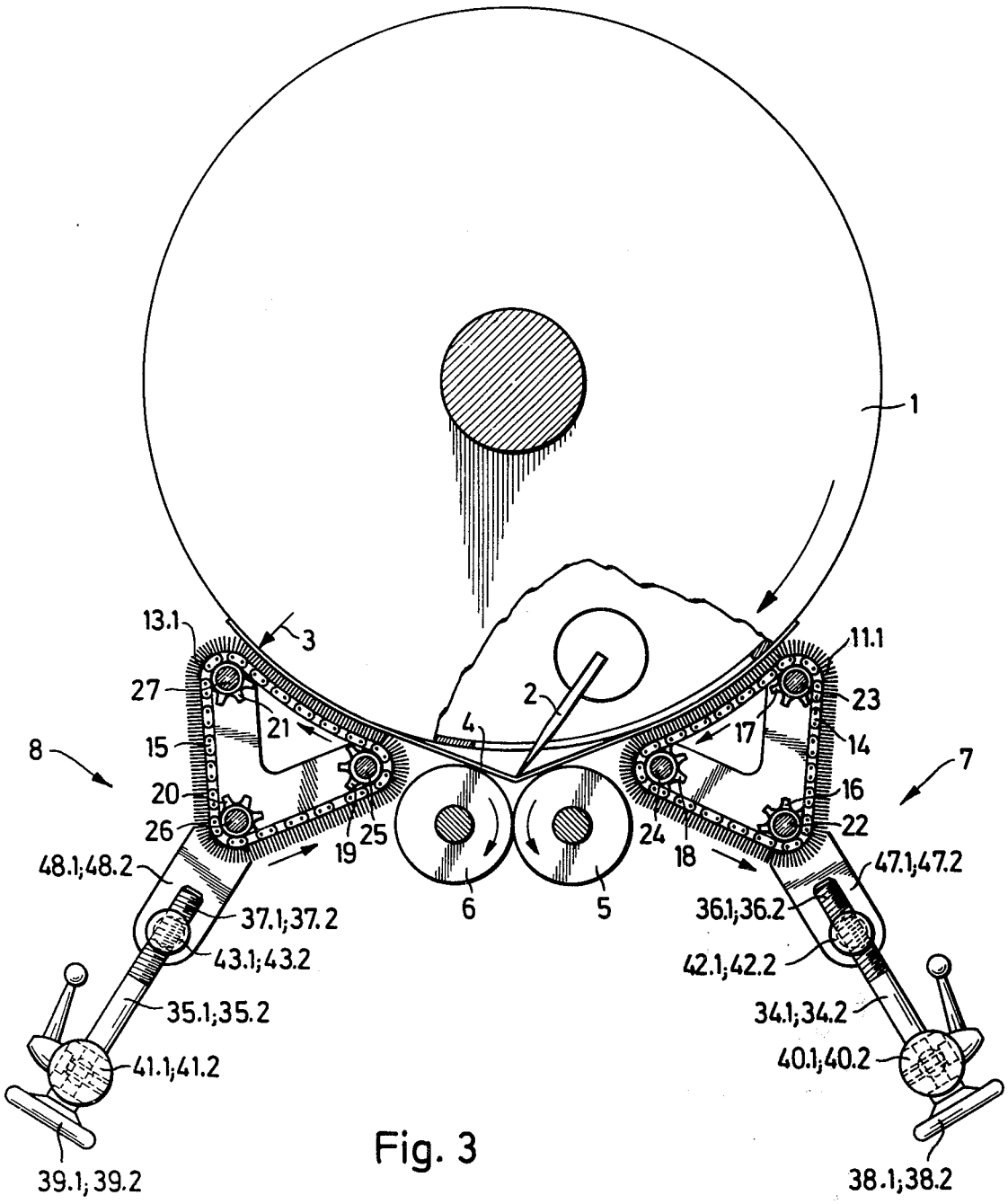
FIG. 3 is a schematic side elevation view of a second embodiment of a gear folder in accordance with the present invention, the side rails having been removed for clarity.

As an alternative to the disks 9, 12 equipped with bristles, it is also possible to use toothed belts 14, 15 as may be seen in FIG. 3. Belts 14, 15 may be equipped with bristles 11.1, 13.1 and a plurality of such belts may be disposed side by side similarly to the positioning of disks 9 and 12. Toothed wheels 16–21, which mesh with the teeth of the toothed belts 14, 15 are secured on shaft 22 to 27.

Power input to the toothed belts 14, 15 is effected from the drive of the gear folding mechanism through the shafts 24 and 25. The direction of rotation of the toothed belts 14, 15 is opposite to the direction of rotation of the gear folding cylinder 1, the rotating speed of the toothed belts 14 being up to 30 percent less than the peripheral speed of the gear folding cylinder 1, and the rotating speed of the toothed belts 15 being up to 30 percent more than the peripheral speed of the gear folding cylinder 1.

Shafts 22 to 27 are supported in Y-shaped brackets 47.1, 47.2, 48.1, 48.2. Brackets 47.1, 47.2, 48.1, 48.2 are supported so as to be capable of being displaced in guide means on the side frames 46.1, 46.2 (not shown). Joint ends 42.1, 42.2 and 43.1, 43.2, which are supported in the brackets 47.1, 47.2, 48.1, 48.2 allow the brackets to be moved. The rods 34.1, 34.2 and 35.1, 35.2 have shouldered outside screw threads 36.1, 36.2, 37.1, 37.2 which engage with inside screw threads in the joint ends 42.1, 42.2, 43.1, 43.2. Supports 40.1, 40.2, 41.1, 41.2, which are fixed in the side frames, support rods 34.1, 34.2, 35.1, 35.2 and allow them to be rotated, but at the same time prevent any displacement of the rods in the direction of their longitudinal axis. Hand wheels 38.1, 38.2, 39.1, 39.2, which are secured on the rods 34.1, 34.2, 35.1, 352., serve for manual adjustment of the distance of the toothed belt series 14 or 15 from the periphery of the gear folding cylinder 1.

The disks 9, 12 or the toothed belts 14, 15 are capable of being positioned by means of the pressure mechanisms 7, 8 at a desired distance from the gear folding cylinder 1, and thus also from the precut collected ribbon sections 4 carried by cylinder 1. When the precut collected ribbon section 4 carried on cylinder 1 has been clamped between the disks 9 or belts 14 and the gear folding cylinder 1 on one side or before the folding rollers 4, 5, and between the disks 12 or belts 15 and the gear folding cylinder 1 on the other side or after the folding rollers 5, 6, the precut collected ribbon section 4 is tensioned around the periphery of the gear folding cylinder 1. This is accomplished because the peripheral speed of the disks 9 or belts 14 is slower than the peripheral speed of the gear folding cylinder 1, and the peripheral speed of the disks 12 or belts 15 is faster than the peripheral speed of the gear folding cylinder 1. By keeping the precut collected ribbon section 4 tightened around the periphery of the gear folding cylinder 1, particularly at the spot where the folding blade 2 protrudes from the periphery of the gear folding cylinder 1, it is possible for the action line of the folding blade 2 to correspond with the predetermined folding line. Thus, precision of the folding procedure is assured.

What we claim is:

1. A gear folder for folding precut ribbon segments, said gear folder including a gear folding cylinder rotatable at a first speed in a first direction about a longitudinal axis and having at least one folding blade, and at least one pair of folding rollers for folding said ribbon segments inserted between said pair of folding rollers by said folding blade, said gear folder further including ribbon tensioning means to tension said ribbon segments against said folding cylinder, said ribbon tensioning means comprising:

a first rotating pressure means exerting pressure against said folding cylinder and being positioned in front of said pair of folding rolls in said first direction of rotation of said folding cylinder and extending generally parallel to said longitudinal axis of said folding cylinder;

a second rotating pressure means exerting pressure against said folding cylinder and being positioned behind said pair of folding rolls in said first direction of rotation of said folding cylinder and extending generally parallel to said longitudinal axis of said folding cylinder;

means for rotating said first and second pressure means in a second direction opposite to said first direction of rotation of said folding cylinder and at speeds different from each other and from said first speed of rotation of said folding cylinder; and means for adjusting said pressure exerted by said first and second rotating pressure means against said folding cylinder whereby said ribbon segments are tensioned against said folding cylinder by said first and second rotating pressure means.

2. The gear folder of claim 1, wherein each of said first and second rotating pressure means includes a plurality of disks secured to a rotatable shaft, each of said disks having bristles about its periphery.

3. The gear folder of claim 2 wherein each of said shafts is rotatably carried in angle levers, said angle levers being adjustably secured to frame portions of said gear folder.

4. The gear folder of claim 1 wherein each of said first and second rotating pressure means includes a plurality of rotating toothed belts, each of said belts having bristles about its periphery.

5. The gear folder of claim 4, wherein said toothed belts are carried on toothed wheels, said wheels being mounted on shaft supported in Y-brackets.

6. The gear folder of claim 5, wherein said Y-brackets are adjustable toward and away from said gear folding cylinder to vary said pressure exerted on said cylinder by said toothed belts.

* * * * *